US005813669A

United States Patent [19]

Horii

[11] Patent Number: 5,813,669

[45] Date of Patent: Sep. 29, 1998

[54] PAPER SUPPLYING DEVICE AND A ROTOR THEREFOR

[75] Inventor: Yoshiyuki Horii, Kyoto, Japan

[73] Assignee: Horizon International, Inc., Shiga, Japan

[21] Appl. No.: 779,629

[22] Filed: Jan. 7, 1997

[30] Foreign Application Priority Data

Jun. 8, 1996 [JP] Japan ..... 8-182647
Jul. 2, 1996 [JP] Japan ..... 8-207545

[51] Int. Cl.[6] ..... B65H 5/08

[52] U.S. Cl. ..... 271/12; 271/94; 271/98; 271/105; 271/124

[58] Field of Search ..... 271/12, 94, 98, 271/105, 30.1, 196, 124

[56] References Cited

U.S. PATENT DOCUMENTS

| | | | |
|---|---|---|---|
| 3,025,052 | 3/1962 | Gutteling | 271/94 |
| 3,148,876 | 9/1964 | Chandler et al. | 271/12 |
| 4,312,503 | 1/1982 | Saxinger et al. | 271/124 |
| 4,345,752 | 8/1982 | Nakamura et al. | 271/12 |
| 4,678,176 | 7/1987 | Roller | 271/94 |
| 5,088,717 | 2/1992 | Hamanaka et al. | 271/12 |
| 5,494,398 | 2/1996 | Montemayor et al. | 271/94 |

*Primary Examiner*—H. Grant Skaggs
*Attorney, Agent, or Firm*—Majestic, Parsons, Siebert & Hsue P.C.

[57] ABSTRACT

A paper supplying device has a shelf for placing sheets of paper to be supplied and a suction rotor disposed above the shelf. The suction rotor has suction openings on outer peripheral surfaces and can suck up the paper from the shelf by sucking in air through the sucking openings. A belt is passed over a pulley around the suction rotor not only causes the suction rotor to rotate but also serves to guide the sucked paper forward tangentially with respect to the rotor, preventing the paper from becoming wound up around the rotor. The device may also include nozzles for blowing air toward front edge of the sucked paper, gate plates for blocking any overlapping sheet of paper which may be attached to the sucked paper, nozzles for blowing air to separate any overlapping sheet of paper which may be attached to the sucked paper, or a friction pad which has a coefficient of friction smaller than that of the belt and is adjustably disposed so as to be selectably either in contact or not in contact with the belt. The suction rotor is formed by assembling one or more rotor units of a simple structure, each having a disk-shaped base plate with a throughhole at the center, a plurality of radially oriented partition walls standing on one of the surfaces of the base plate and as many peripheral walls, each associated with a corresponding one of the partition walls and disposed around the outer periphery of the base plate with gaps in between. These suction units are assembled, walls of one unit engaging with the base plate of another unit.

10 Claims, 5 Drawing Sheets

PAPER SUPPLYING DEVICE AND A ROTOR THEREFOR

BACKGROUND OF THE INVENTION

This invention relates to a paper supplying device adapted to supply paper one sheet at a time from a pile. This invention also relates to a suction rotor usable in such a paper supplying device.

Many paper supplying devices of this type are used, for example, in a collator for transporting paper to be collated before being bound. Some of such paper supplying devices make use of a suction pad to pick up one sheet at a time from a pile of paper and transport it to a specified work place. There are also those provided with a hollow cylindrical rotor having radially extending openings through the shell adapted to suck up a sheet of paper through appropriate ones of these openings and to transport it by its rotation.

Paper supplying devices using such a rotor are advantageous in that they can supply paper at a faster rate, but rotors with a large diameter are not practical for a collator where a plurality of paper supplying devices must be used, generally arranged in a multi-stage formation. If rotors with a small diameter are used, however, the sheet of paper picked up thereby tends to roll around it and to become caught by it instead of being delivered to its intended destination. The rotors therefore cannot be rotated too fast, and this defeats the very purpose of using this kind of paper supplying device. It is therefore one of the objects of this invention to provide an improved paper supplying device which can use a rotor with a smaller diameter without causing the paper to become wound up and can pick up paper reliably one sheet at a time.

FIGS. 8 and 9 show an example of prior art paper supplying device 201 of this type having a hollow cylindrical suction rotor 203 disposed above a forward edge of a paper-carrying shelf 202 upon which piled sheets of paper P to be supplied are placed. The suction rotor 203 is rotatably supported around a horizontally extending air conducting pipe 204, of which the hollow interior serves as an air passage, and is provided with many radially extending suction openings 205 arranged in circumferential and axial directions. As shown in FIG. 9, the suction openings 205 penetrate the cylindrical shell of the suction rotor 203 from its inner peripheral surface to its outer peripheral surface, and the air conducting pipe 204 is provided with a connector opening 206 opposite the piled-up paper P on the shelf 202 such that the top sheet of the piled paper P will be sucked to the suction openings 205 of the suction rotor 203 which are then in an air-communicating relationship with the connector opening 206 of the pipe 204. In other words, atmospheric air is sucked through different ones of these suction openings 205 which sequentially become aligned with the connector opening 206, as the suction rotor 203 rotates, and the negative pressure thereby created causes the adsorption of the top sheet of the piled paper P on the shelf 202. The sheet of paper thus adsorbed is then transported forward away from the pile as the suction rotor 203 is rotated. In FIG. 8, numeral 207 indicates a pulley over which a belt (not shown) is wound to establish a motion-communicating relationship between a belt-driving motor (not shown) and the suction rotor 203, and numeral 208 indicates a positioning ring for positioning the suction rotor 203 appropriately on the pipe 204.

Suction rotors, as described above, are conventionally produced by forming suction openings through a relatively thick cylindrical shell which serves as the main body of the suction rotor. Thus, production of prior art suction rotors as shown in FIGS. 8 and 9 was a troublesome procedure and suction rotors thus produced were costly. In the case of a collator which employs a large number of paper supplying devices, in particular, prior art suction rotors affect the overall production cost significantly. It is therefore another object of this invention to provide a suction rotor for such a paper supplying device which can be produced easily and inexpensively.

SUMMARY OF THE INVENTION

A paper supplying device embodying this invention may be characterized as comprising a shelf for placing sheets of paper to be supplied thereon, a suction rotor which is disposed above the shelf, having suction openings on outer peripheral surfaces and being adapted to suck up the paper placed on the shelf by sucking in air through these sucking openings, a belt for not only causing this suction rotor to rotate but also guiding the sucked paper forward tangentially with respect to the rotor, and a pulley for causing the belt to move around. The device may further comprise nozzles for blowing air toward front edge of the sucked paper, gate plates for blocking any overlapping sheet of paper which may be attached to the sucked paper, nozzles for blowing air to separate any overlapping sheet of paper which may be attached to the sucked paper, or a friction pad which has a coefficient of friction smaller than that of the belt and is adjustably disposed so as to be selectably either in contact or not in contact with the belt.

With a paper supplying device structured as above, each sheet of paper sucked up by the suction roller is guided by the belt and can be transported forward tangentially with respect to the roller without becoming wound around the rotor. The nozzles, the gate plates and the suction pads can serve, either singly or in combination, to prevent two or more sheets of paper from becoming sucked up and supplied forward together.

A suction rotor embodying the invention may be characterized as comprising one or more rotor units. Each rotor unit comprises a disk-shaped base plate with a throughhole at the center for allowing a suction pipe to pass through, and a tubularly shaped driver ring having a throughhole at its center for allowing the suction pipe to pass through. Each rotor unit has a plurality of radially oriented partition walls standing on one of the surfaces of the base plate and as many peripheral walls, each associated with a corresponding one of the partition walls and disposed around the outer periphery of the base plate with gaps therebetween. One end of the driver ring is connected to the partition walls and the peripheral walls of one of the rotor units. The partition walls, the peripheral walls and the base plate of each rotor unit may be integrally formed.

A suction rotor with such a structured can be manufactured easily and inexpensively because the individual rotor units are of a simple structure and can be easily assembled together.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
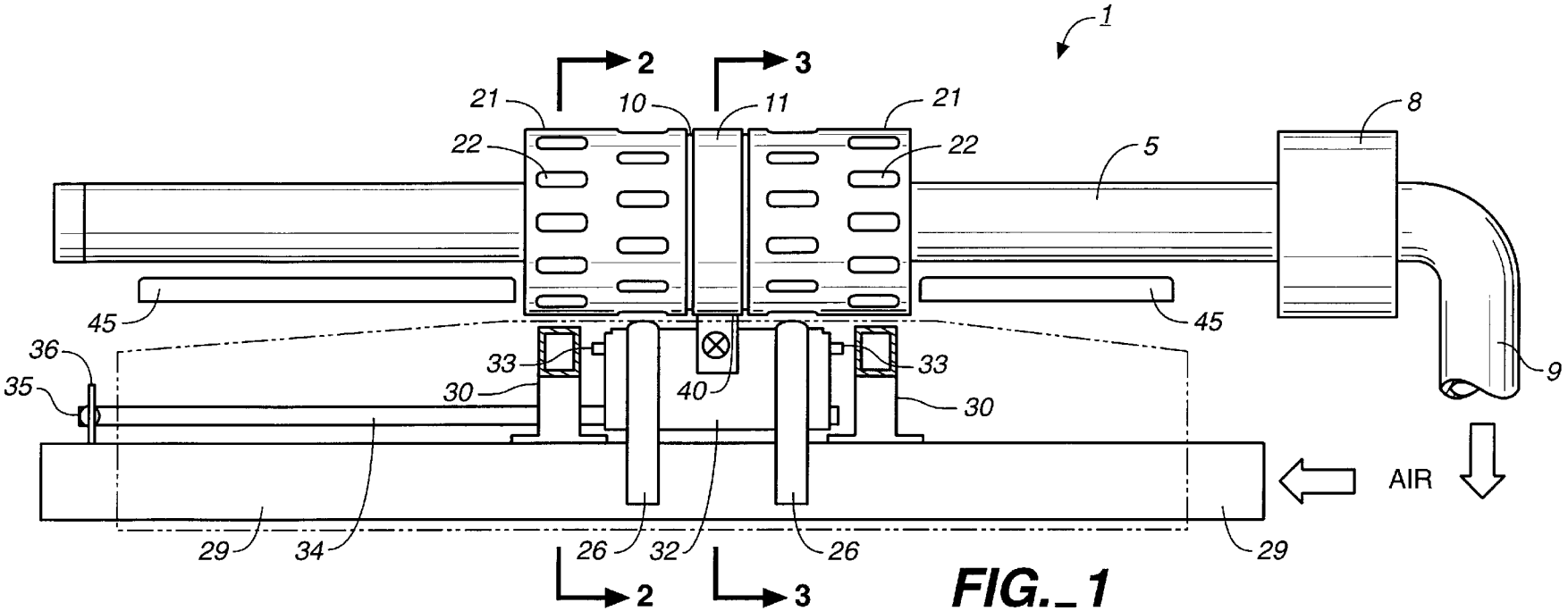
FIG. 1 is a back view of a paper supplying device embodying this invention as seen along the direction in which paper is supplied thereby.
Figure 2:
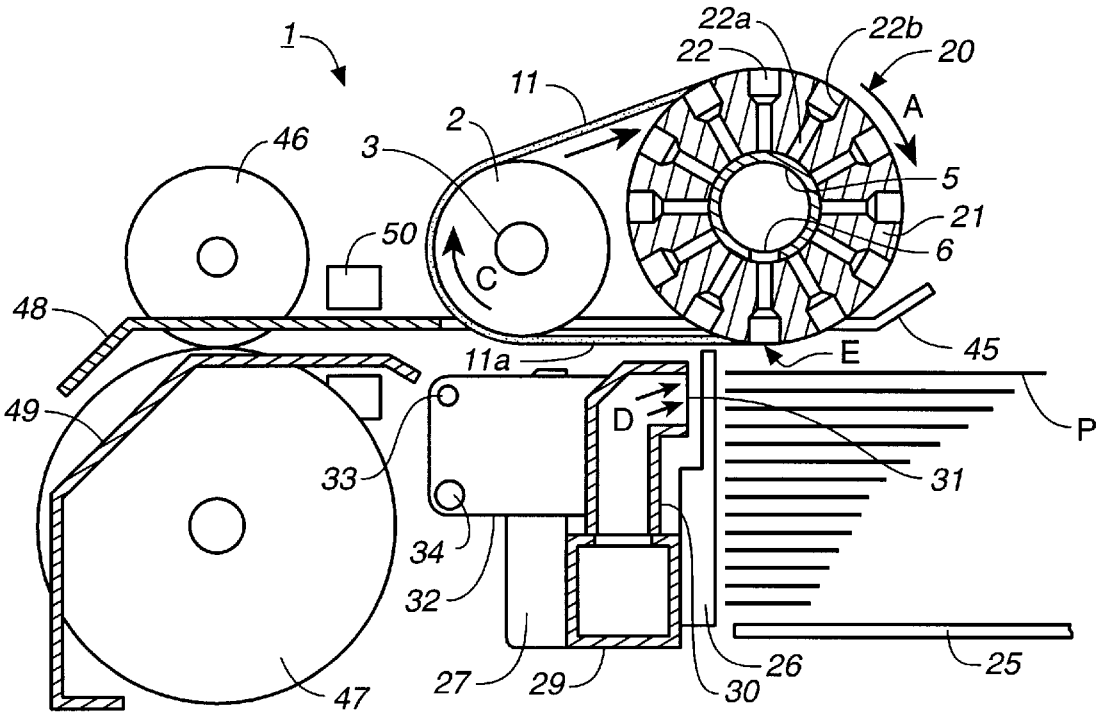
FIG. 2 is a sectional view taken along line 2—2 of FIG. 1.
Figure 3:
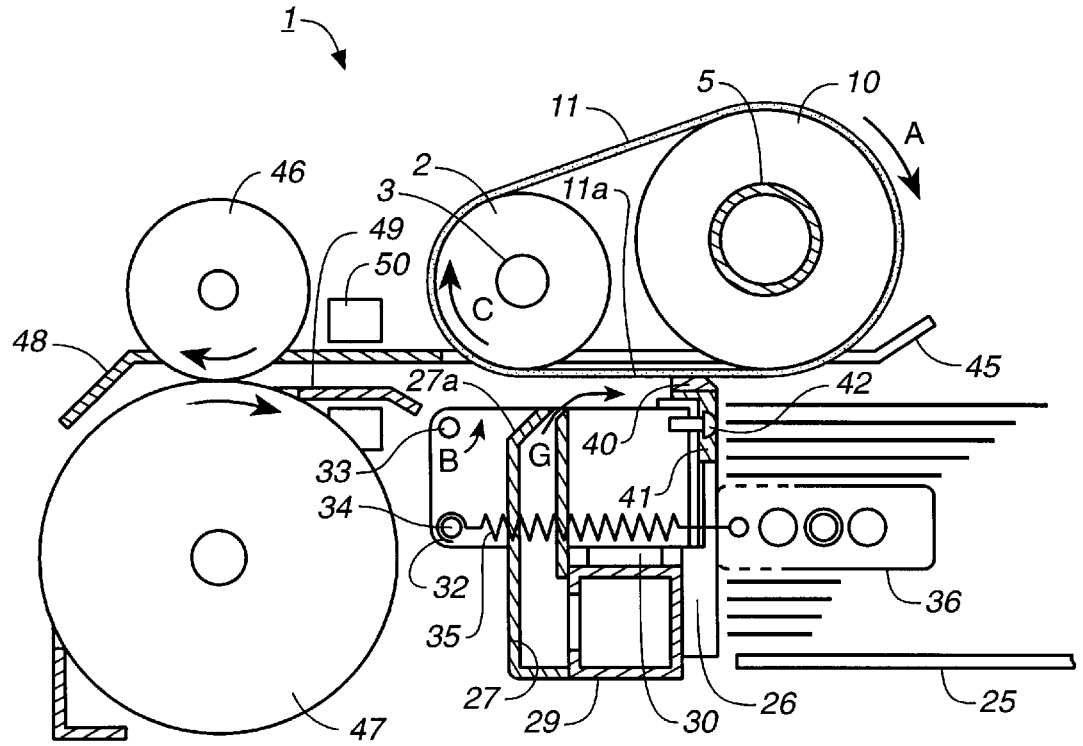
FIG. 3 is a sectional view taken along line 3—3 of FIG. 1.

FIGS. 1, 2 and 3 show a paper supplying device 1 according to one embodiment of this invention, comprising a shelf 25 for placing a pile of paper P to be supplied one sheet at a time, a rotor 21 adapted to suck up the top sheet of the piled paper P on the shelf 25, a belt 11 for transporting along a specified paper supplying line the sheet of paper P sucked up by the suction rotor 21, air outlets 31 for causing upper sheets of the piled paper P to float, nozzles 27*a* for allowing only the top sheet will remain adsorbed and transported away, gate plates 26 and an adjustable friction pad 40 (to be described below in detail).

When the paper supplying device 1 is in operation, those of the sheets near the top of the pile of paper P placed on the shelf 25 are caused to separately float by the air blown out of the air outlets 31, and the top sheet is sucked and adsorbed onto the rotor 21. The top sheet P thus adsorbed onto the rotor 21 is guided by the belt 11, separated and transported away from the remaining sheets P on the shelf 25. Since air is being caused to flow in the meantime also from the nozzles 27*a* towards the front edge of the adsorbed sheet P, it is made sure to prevent the second sheet of the pile from remaining attached to and being carried off together with the top sheet. The gate plates 26 are adapted to generally prevent the pile of paper P from moving forward in the direction of transportation of the sheets. The friction pad 40, against which the belt 11 slides, can also be used to separate the top sheet from the rest. For this purpose, the coefficient of friction of the friction pad 40 is made somewhat smaller than that of the belt 11. Explained more in detail with reference to FIG. 2, the paper supplying device 1 has a cylindrical rotor 21 disposed above an edge of the shelf 25 which is for positioning thereon the paper P to be supplied and is adapted to move vertically according to the height of the pile of paper P placed thereon such that the top sheet of the pile will be at a specified height. The rotor 21 is rotatably supported by a suction pipe 5 and has many suction openings 22 extending radially.

These suction openings 22 penetrate the cylindrical shell of the rotor 21 from its inner peripheral surface to its outer peripheral surface, with their inward portions 22*a* made narrower than their outward portions 22*b*, the openings of these outward portions 22*b* being elongated, as shown in FIG. 1, in the direction of the axis of rotation of the rotor 21. As shown also in FIG. 1, the suction openings 22 are arranged in a plurality of rows in the direction of this axis of rotation of the rotor 21 at a uniform pitch, the suction openings 22 of mutually adjacent rows being displaced mutually by a half pitch.

With reference still to FIG. 1, the suction pipe 5 extends perpendicularly to the direction of the aforementioned paper supplying line. The interior of the suction pipe 5 serves as an air passage, one end being blocked and the other connected through an electromagnetic valve 8 to a suction source pipe 9. The middle section of the suction pipe 5 is structured as a hollow pipe with a specified strength, rotatably supporting the rotor 21. A connector opening 6 is formed through the suction pipe 5 opposite the top sheet of the pile of paper P on the shelf 25, as shown in FIG. 2, such that only those of the suction openings 22 which have reached their lowest positions as the rotor 21 rotates around its axis are in air-communicating relationship with this connector opening 6. In other words, air can be sucked into the hollow interior of the suction pipe 5 only through those of the suction openings 22 pointing downwards and opening into the connector opening 6, causing the top sheet of the pile of paper P to be adsorbed to the rotor 21.

There is a follower pulley 10, either engaged to or integrally formed with the rotor 21, and the rotor 21 is separated into two parts with one part on either side of the pulley 10 on the suction pipe 5, as shown in FIG. 1, such that both parts of the rotor 21 rotate together with the pulley 10 in between. A belt 11, made of a material with a large coefficient of friction such as rubber, is passed over the follower pulley 10 and a driver pulley 2 disposed in front (that is, on the downstream side with respect to the paper supplying line) of the follower pulley 10 and connected to the drive shaft 3 of a motor (not shown) such that the rotary motion of the driver pulley 2 (indicated by Arrow C in FIGS. 2 and 3) is communicated to the rotor 21 (indicated by Arrow A in FIGS. 2 and 3).

The follower pulley 10 is designed such that the outer diameter of the belt 11 therearound will be approximately equal to the outer diameter of the rotor 21 and that the lower side 11*a* of the belt 11 will be parallel to the paper supplying line. As a result, the sheet of paper P sucked onto the rotor 21 is naturally guided by the lower side 11*a* of the belt 11 and transported forward tangentially to the lowest point on the periphery of the rotor 21.

An air conduit 29, connected below to a blower (not shown), is disposed in front of the shelf 25 (on the side into which the sheets of paper P are supplied), extending parallel to the suction pipe 5. A pair of vertical tubes 30, in an air-communicating relationship with this air conduit 29, is connected to its upper surface, sandwiching the belt 11 from both sides. The upper ends of these vertical tubes 30 are open, serving as the aforementioned air outlets 31 through which air can be caused to flow out, as indicated by Arrow D, so as to individually separate the upper part of the pile of paper sheets P.

As shown in FIG. 3, there is another pair of vertical tubes 27 in an air-communicating relationship with the air conduit 29, and connected to a side surface thereof. The upper ends of these tubes 27 are also open, forming the aforementioned nozzles 27*a* through which air can be caused to flow out towards the front edge of the sheet of paper P sucked up by the rotor 21 and to make certain that no other sheet or sheets of paper P have been sucked up together with the top sheet which alone is intended to be picked up and transported forward. The nozzles 27*a* are formed such that the air therefrom will flow backward and diagonally upward, as indicated by Arrow G, towards the rotor 21 along the lower side 11*a* of the belt 11.

On the side surface of the air conduit 29 facing the shelf 25, furthermore, the aforementioned gate plates 26 are attached on both sides of the belt 11, as shown in FIGS. 1, 2 and 3. The gate plates 26 are for the purpose of preventing any additional sheet or sheets of paper P from remaining attached to the one at the top and being supplied forward with the top sheet. For this reason, as more clearly shown in FIGS. 1 and 2, the top edges of the gate plates 26 are positioned exactly on the same horizontal plane as the horizontal bottom surface of the lower side 11*a* of the belt 11.

The friction pad 40, adapted to be pressed upward against the lower side 11*a* of the belt 11, is disposed below the lower side 11*a* of the belt 11 on its downstream side into which sheets of paper P are supplied, as shown in FIG. 3. The friction pad 40 is affixed to a supporting member 41 which, in turn, is affixed to the top of the back edge of a generally U-shaped supporting frame 32 by means of screws 42. The supporting frame 32 has two side plates which are rotatably supported by a fixed frame (not shown) around pins 33 at top front parts of the side plates. An elongated rod 34 extends sideways from a lower part of one of the side plates, as shown in FIG. 1, and a spring 35 is stretched between this rod 34 and a bracket 36 attached to a fixed frame (not shown). The supporting frame 32 is biased to rotate around the pins 33 as indicated by Arrow B by the tensile force of the spring 35 on the rod 34, causing the friction pad 40 to be compressed against the lower side 11*a* of the belt 11.

Since the position for affixing the bracket 36 can be adjusted, the tensile force of the spring 35 can be varied and the compressive force of the friction pad 40 against the lower side 11*a* of the belt 11 can be controlled. Moreover, the friction pad 40 can be released from contact with the belt 11 by rotating the supporting frame 32 opposite to the direction of Arrow B. In other words, the friction pad 40 can be selectably contacted with or removed from the belt 11.

This friction pad 40 also serves to prevent two or more sheets of paper from being supplied together at the same time. For this purpose, it is made of a material such as urethane having a coefficient of friction smaller than that of the belt 11 made of rubber such that, if there is only one sheet in contact with the belt 11, the pad 40 will slide over the surface of the paper but if there are two or more sheets, only the sheet directly in contact with the belt 11 will be left on and the rest will be separated therefrom by friction.

A pair of discharge rollers 46 and 47 is provided at the front end of the paper supplying device 1, separated from the driver pulley 2 by a specified distance, serving to receive the paper transported forward by the rotor 21 and the belt 11 and to further discharge the received paper P. An upper guide plate 45 and a lower guide plate 49 are provided respectively above and below the paper supplying line from the shelf 25 to a paper discharging position. A sensor 50, adapted to output a detection signal when the passing front edge of a sheet of paper P is thereby detected, is disposed on the upstream side of the discharge rollers 46 and 47. The driving of the rotor 21 is controlled by this detection signal.

Next, the mode of operating the paper supplying device 1, thus structured, will be explained in detail. First, as the electromagnetic valve 8 is opened with the shelf 25 loaded with a pile of paper P, the driver pulley 2 is caused to rotate in the direction of Arrow C and the rotor 21 through the belt 11 to rotate as shown in Arrow A. When certain suction openings 22 on the rotor 21 come to the connecting position with the connector opening 6, air is sucked therethrough as indicated by Arrow E and the top sheet P of the pile on the shelf 25 is picked up by the rotor 21.

At the same time, air is blown out through the air outlets 31 as indicated by Arrow D such that paper sheets P in an upper part of the pile are separated and caused to float. This makes it easier for the rotor 21 to suck up only the top one of the sheets from the pile.

The top sheet of the pile thus sucked up by the rotor 21 is moved forward horizontally, guided by the belt 11 along the paper supplying line, as the rotor 21 rotates. The sheet is then received by the discharge rollers 46 and 47 and discharged vertically downward along the guide plates 45 and 49.

When the front edge of this sheet passes the position of the sensor 50, the electromagnetic valve 8 is closed after a specified length of time dependent on the length of the paper P and the speed of its motion, stopping the suction of air through the rotor 21 and the motion of the driver pulley 2, thereby preventing the next sheet from becoming forwarded continuously. The system waits instead, until a start signal is inputted from a control unit (not shown) for repeating the next cycle of the paper-supplying operations described above.

Because the sheet, once picked up by the rotor 21, is transported forward, being guided by the belt 11 which is at the center of the rotor 21, the problem of the paper sheet winding up around the rotor in the case of a prior art paper supplying device can be prevented even if the rotor with a smaller diameter is used.

Sheets of paper are more likely to stick together if the paper is of a kind capable of passing air through or by the printing ink thereon. Even in such a case, the gate plates 26 serve to block the next sheet stuck to the top sheet such that only the top sheet will be supplied. The air, blown out through the nozzles 27*a* towards the front edge of the top sheet being sucked up by the rotor 21, also serves to separate the second sheet which may be stuck to the top sheet as it flows into the space between them. With the air thus blown towards the front edges of the sheets, the operation of the gate plates 26 becomes more effective even if the separation between the sheets made by the air alone may be insignificantly small.

Because the friction pad 40 can be set adjustably, as explained above, the compressive force between the friction pad 40 and the lower side 11*a* of the belt 11 may be adjusted such that the extra sheet which may have been sucked up by the rotor 21 and in contact with the friction pad 40 will be separated from the top sheet by the difference in coefficient of friction.

Although only one paper supplying device has been described above, this example is not intended to limit the scope of the invention. Many modifications and variations are possible within the scope of the invention. For example, although an example was shown above with only one belt 11 around the pulley 10 at the center of the rotor 21 to guide the sheets to be supplied, two or more mutually parallel belts may be employed by providing as many follower pulleys (although not shown).

As another example, although a paper supplying device embodying this invention was described above with reference to FIGS. 1, 2 and 3 as using a rotor of a prior art variety, it was only for the purpose of showing one of the aspects of the invention. In what follows, another aspect of the invention related to a novel structure of rotor, which is also usable with the paper supplying device described above, will be described in detail with reference to FIGS. 4, 5, 6 and 7.

Figure 4:
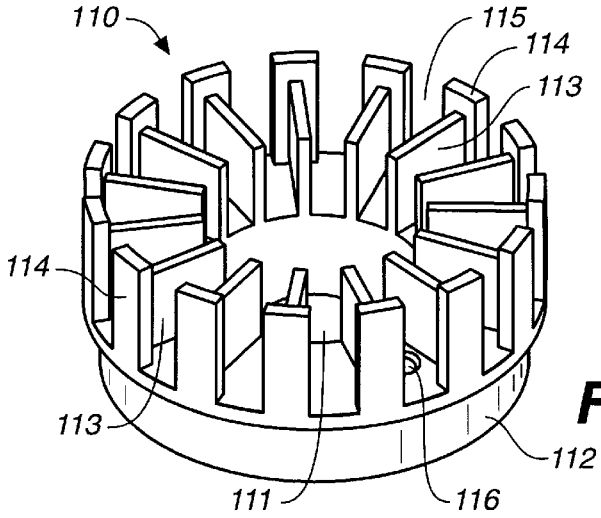
FIG. 4 is a diagonal view of a rotor unit embodying this invention.
Figure 5:
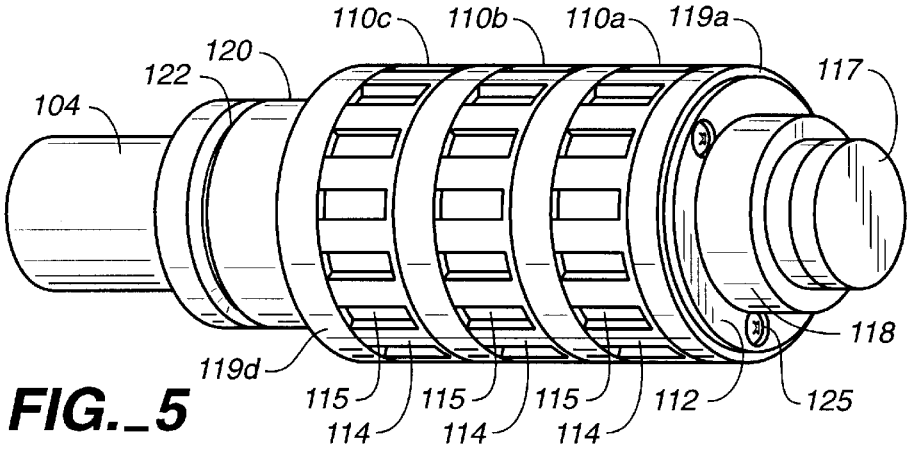
FIG. 5 is a diagonal view of a suction rotor using rotor units shown in FIG. 4.
Figure 6:
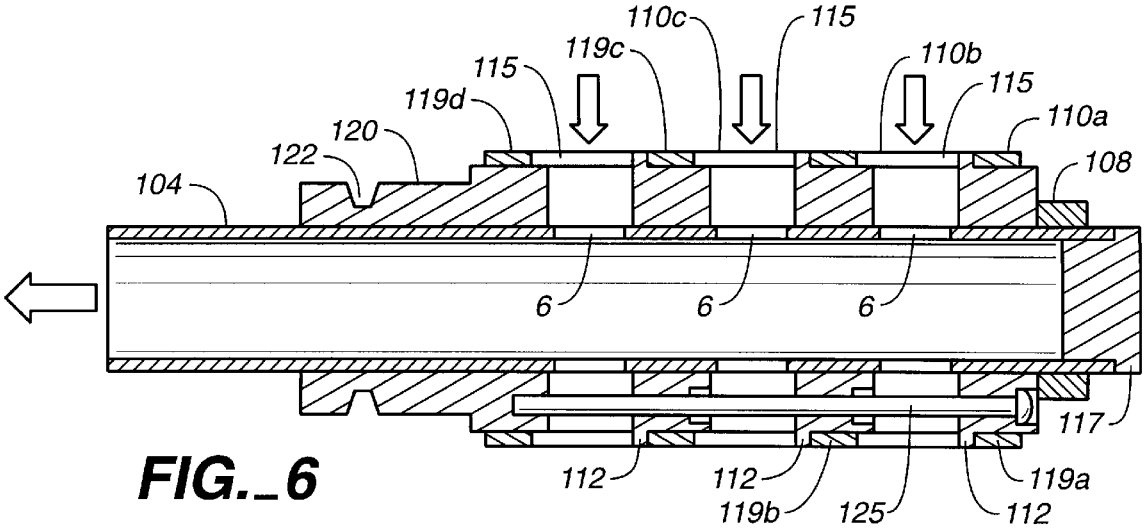
FIG. 6 is a sectional view of the suction rotor of FIG. 5.
Figure 7:
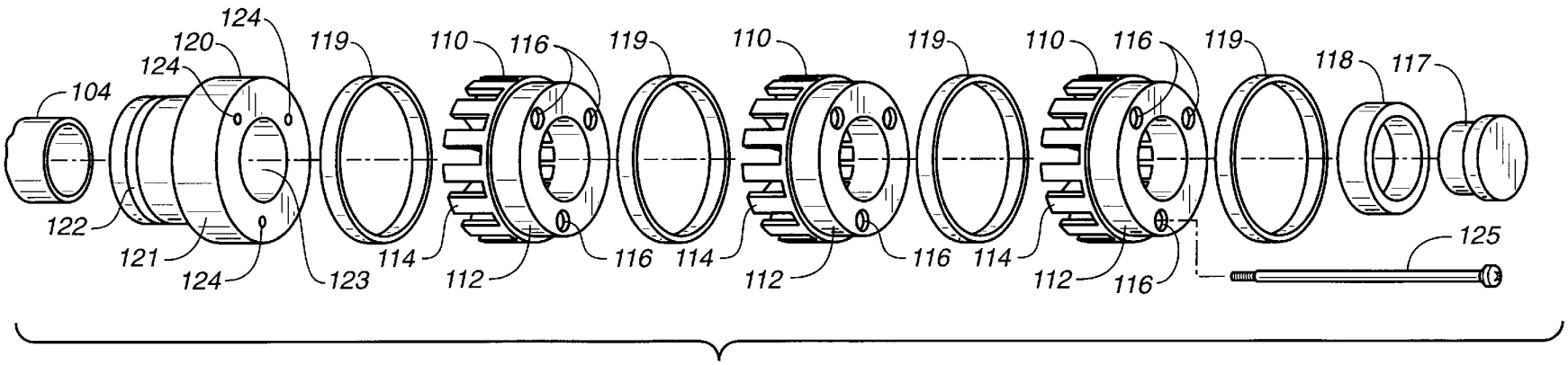
FIG. 7 is an exploded view of a suction rotor using rotor units as shown in FIG. 4.
Figure 8:
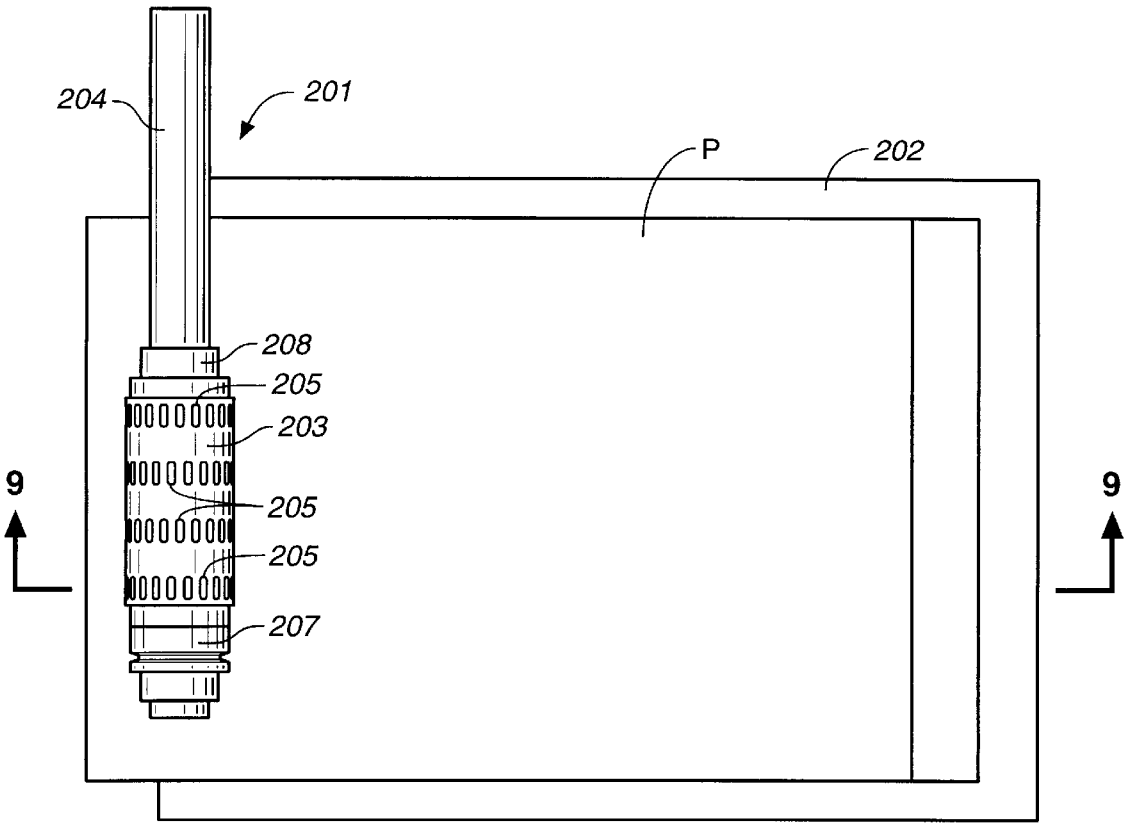
FIG. 8 (PRIOR ART)
FIG. 8 is a plan view of a prior art paper supplying device using a suction rotor.
Figure 9:
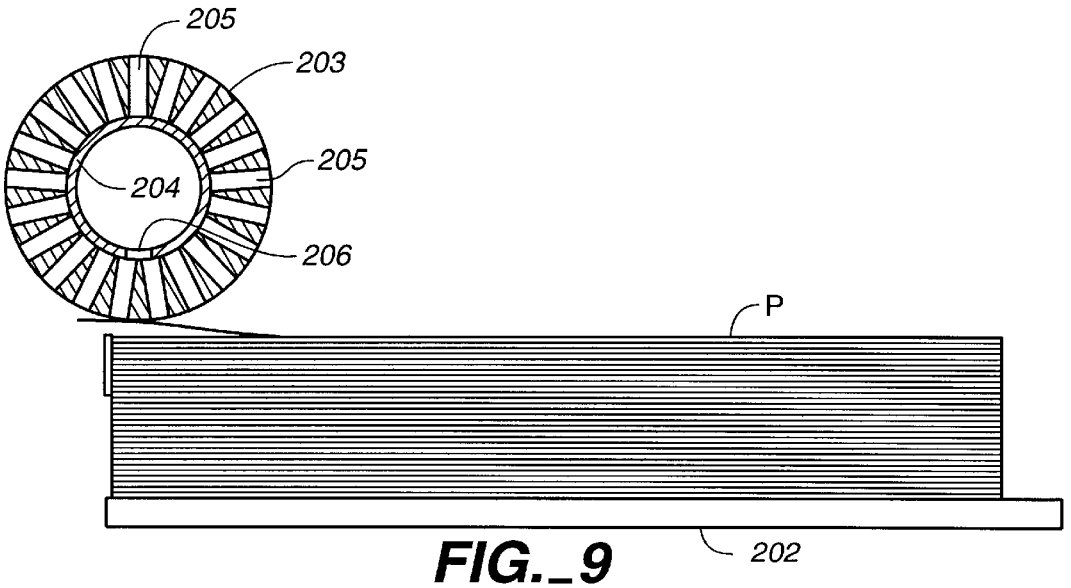
FIG. 9 (PRIOR ART)
FIG. 9 is a sectional view taken along line 9—9 of FIG. 8.

As shown in FIGS. 5, 6 and 7, a rotor having a novel structure embodying this invention comprises a plurality (three, in the illustrated example) of rotor units 110 (indicated individually as 110*a*, 110*b* and 110*c* in FIGS. 5 and 6). As shown in FIG. 4, each rotor unit 110 comprises a circular disk-shaped base plate 112 having a throughhole 111 at the center for accepting therethrough a suction pipe 105, planar partition walls 113 which stand on one of the surfaces of the base plate 112 and extending radially, and peripheral walls 114 which also stand on the same surface of the base plate 112 but along its periphery and are each connected to the outer edge of a corresponding one of the partition walls 113. Each of the mutually adjacent pairs of the peripheral walls has a gap 115 therebetween of about the same width as that of each peripheral wall 114. Numerals 116 indicate holes for passing a bolt through.

The upper surface part (as seen in FIG. 4) of the base plate 112 where the peripheral walls 114 are formed has a larger diameter than the lower surface part by the thickness of the peripheral walls 114, and the outer diameter on the lower surface part is such that the inner peripheral surface of the peripheral walls 114 (of the adjacent rotor unit) can be engaged. The peripheral walls 114 are formed so as to protrude in the circumferential directions from the corresponding one of the partition walls 113 on both sides, but the partition walls 113 and the peripheral walls 114 may be formed integrally. In such a case, the partition walls 113 are made thicker towards the periphery, and the rotor units may be formed integrally by plastic molding or die cast molding.

A plurality (such as three) of such rotor units 110 are assembled, as shown in FIG. 7, to form a suction rotor shown in FIGS. 5 and 6. In FIG. 7, numeral 104 indicates a suction pipe of which the interior serves as an air passage, having air inlets 106 at positions facing the paper P, numeral 117 indicates a plug for blocking one end of the suction pipe 104, numeral 118 indicates a position fixing ring, numerals 119*a*, 119*b*, 119*c* and 119*d* indicate rubber rings with outer diameter equal to the larger diameter of the base plate 112, and numeral 120 indicates a tubularly shaped driver ring.

The driver ring 120 has a throughhole 123 at the center for passing the suction pipe 104 therethrough. The outer peripheral surface 21 at one end is formed so as to be engageable with the inner peripheral surfaces of the peripheral walls 114, and a groove 122 is formed on the outer peripheral surface on the opposite side for hanging a belt. Numerals 124 indicate holes for accepting the tips of bolts 25 passed through the holes 116 of the individual rotor units 110.

For forming the suction rotor, the driver ring 120 is first set on the suction pipe 104, a rubber ring 119*d* is set on the outer peripheral surface of the driver ring 120, a rotor unit 110*c* is set on the suction pipe 104, and the inner peripheral surfaces of the peripheral walls 114 of the rotor unit 110*c* are set over the outer peripheral surface 121 of the driver ring 120. Next, a second rubber ring 119*c* is set on the outer peripheral surface of the rotor unit 110*c* on the side of the smaller diameter, the next rotor unit 110*b* is set on the suction pipe 104 and the inner peripheral surfaces of the peripheral walls 114 of this rotor unit 110*b* is engaged with the outer peripheral surface of the rotor unit 110*c* on the side of the smaller diameter.

Similarly, the third rotor unit 110*a* is set on the suction pipe 104, and bolts 121 are inserted through the holes 116 on each rotor unit to fasten the rotor units onto the driver ring 120. Finally, the fastening ring 118 is set on the suction pipe 104 to fasten the suction rotor, and the plug 117 is inserted at one end of the suction pipe 104.

The suction rotor thus assembled is rotatably supported by the suction pipe 104 and is rotated by a belt (not shown) passed around the groove 122 on the driver ring 120. The suction pipe 104 is connected also to a vacuum pump (not shown) such that atmospheric air is discharged as shown by arrows in FIG. 6 through the gaps 115 between the peripheral walls, the space surrounded by the partition wall surfaces and the base plate surface or an end surface of a bearing, the air inlets 106 through the suction pipe 104 and the interior of the suction pipe 104 itself, and the sheet of paper positioned opposite the air inlets 106 is sucked to the gaps 115 between the peripheral walls.

Although only one suction rotor embodying this invention was described above, neither is this intended to limit the scope of the invention. Many modifications and variations are possible within the scope of the invention. For example, although a suction rotor with three rotor units was described above, the number of rotor units to be assembled may be selected appropriately. The rotor units which are assembled need not be fastened by means of bolts but may be fastened one another by means of an adhesive. The gaps between the peripheral walls of different rotor units need not be aligned but may be staggered or in a zigzag formation in the axial direction.

In summary, the present invention makes it unnecessary to drill suction openings to produce a suction rotor, and rotor units can be produced easily by means of a simple mold. Thus, suction rotors can be produced inexpensively.

What is claimed is:

1. A paper supplying device comprising:

a shelf for placing sheets of paper to be supplied thereon;

a suction rotor which is disposed above said shelf, said suction rotor having suction openings on outer peripheral surfaces and being adapted to suck up said paper placed on said shelf by sucking in air through said sucking openings;

a belt for causing said suction rotor to rotate and guiding said sucked paper forward tangentially with respect to said rotor;

a pulley for causing said belt to move around;

nozzles for blowing air therethrough toward front edge of said sucked paper; and a friction pad having a coefficient of friction smaller than the coefficient of friction of said belt, said friction pad being adjustably disposed so as to be selectably either in contact or not in contact with said belt.

2. A paper supplying device comprising:

a shelf for placing sheets of paper to be supplied thereon;

a suction rotor which is disposed above said shelf, said suction rotor having suction openings on outer peripheral surfaces and being adapted to suck up said paper placed on said shelf by sucking in air through said sucking openings;

a belt for causing said suction rotor to rotate and guiding said sucked paper forward tangentially with respect to said rotor;

a pulley for causing said belt to move around;

nozzles for blowing air therethrough to separate an overlapping sheet of paper which may be attached to said sucked paper and gate plates for blocking said overlapping sheet separated by air through said nozzles; and a friction pad having a coefficient of friction smaller than the coefficient of friction of said belt, said friction pad being adjustably disposed so as to be selectably either in contact or not in contact with said belt.

3. A paper supplying device a shelf for placing sheets of Raper to be supplied thereon;

a suction rotor which is disposed above said shelf, said suction rotor having suction openings on outer peripheral surfaces and being adapted to suck up said paper placed on said shelf by sucking in air through said sucking openings;

a belt for causing said suction rotor to rotate and guiding said sucked paper forward tangentially with respect to said rotor; and a pulley for causing said belt to move around;

wherein said suction rotor comprises:

rotor units each having:

a disk-shaped base plate having an outer periphery and a throughhole at a center for allowing a suction pipe to pass through;

a plurality of partition walls which stand on one of the surfaces of said base plate and are oriented radially; and a plurality of peripheral walls disposed around said outer periphery of said base plate with gaps therebetween and corresponding to said partition walls, each of said peripheral walls being connected to an edge of a corresponding one of said partition walls; and a tubularly shaped driver ring having a throughhole at a center thereof for allowing said suction pipe to pass through, one end of said driver ring being connected to said partition walls and said peripheral walls.

4. The paper supplying device of claim 3 wherein said base plate has an outer peripheral surface, said peripheral walls have inner peripheral surfaces at one end, the outer peripheral surface of the base plate of one said rotor units being engageable with the inner peripheral surfaces of another of said rotor units, the inner peripheral surfaces of each of said rotor units being engageable with said one end of said driver ring.

5. The paper supplying device of claim 4 wherein the base plate, the partition walls and the peripheral walls of each of said rotor units are integrally formed.

6. The paper supplying device of claim 3 wherein the base plate, the partition walls and the peripheral walls of each of said rotor units are integrally formed.

7. A suction rotor for sucking paper comprising:

rotor units each having:

a disk-shaped base plate having an outer periphery and a throughhole at a center for allowing a suction pipe to pass through;

a plurality of partition walls which stand on one of the surfaces of said base plate and are oriented radially; and a plurality of peripheral walls disposed around said outer periphery of said base plate with gaps therebetween and corresponding to said partition walls, each of said peripheral walls being connected to an edge of a corresponding one of said partition walls; and a tubularly shaped driver ring having a throughhole at a center thereof for allowing said, suction pipe to pass through, to end of said driver ring being connected to said partition walls and said peripheral walls.

8.The suction rotor of claim 7 wherein said base plate has an outer peripheral surface, said peripheral walls have inner peripheral surfaces at one end, the outer peripheral surface of the base plate of one of said rotor units being engageable with the inner peripheral surfaces of another of said rotor units, the inner peripheral surfaces of each of said rotor units being engageable with said one end of said driver ring.

9. The suction rotor of claim 8 wherein the base plate, the partition walls and the peripheral walls of each of said rotor units are integrally formed.

10. The suction rotor of claim 7 wherein the base plate, the partition walls and the peripheral walls of each of said rotor units are integrally formed.

* * * * *